US005078407A

United States Patent [19]

Carlston et al.

[11] Patent Number: 5,078,407

[45] Date of Patent: Jan. 7, 1992

[54] EXPANDABLE BLADE, COMPOSITE PLASTIC, BROADHEAD HUNTING ARROW TIP

[76] Inventors: Marvin L. Carlston, 430 N. 470 W., Lehi, Utah 84043; Vaughn R. Anderson, 217 N. 260 W., Orem, Utah 84057

[21] Appl. No.: 581,593

[22] Filed: Sep. 12, 1990

[51] Int. Cl.[5] ..... F42B 6/08

[52] U.S. Cl. ..... 273/421

[58] Field of Search ..... 273/421, 422, 419, 420, 273/416

[56] References Cited

U.S. PATENT DOCUMENTS

| | | | |
|---|---|---|---|
| 2,212,345 | 8/1940 | Krieger | 273/421 |
| 2,289,284 | 7/1942 | Chandler | 273/421 X |
| 2,568,417 | 9/1951 | Steinbacher | 273/421 |
| 2,859,970 | 11/1958 | Doonan | 273/421 |
| 4,099,720 | 7/1978 | Zeren | 273/422 |
| 4,203,601 | 5/1980 | Simo | 273/421 |
| 4,234,191 | 11/1980 | Erlandson | 273/421 |
| 4,676,512 | 6/1987 | Simo | 273/422 |
| 4,940,246 | 7/1990 | Stagg | 273/421 |

*Primary Examiner*—Paul E. Shapiro

*Attorney, Agent, or Firm*—Thorpe, North & Western

[57] ABSTRACT

A multi-bladed expandable broadhead, composite fiber, plastic hunting arrow tip. The tip is comprised of a high strength, light weight fibrous composite plastic material. It incorporates the use of rotatable blades which are trunion mounted securely in the body of the tip, and which are designed to be partially exposed while in flight. The blades are configured such that they will rotate into an expanded position upon impact. The blades are mounted in a forward position with the tips of the blades protruding outside of the tip body.

6 Claims, 2 Drawing Sheets

EXPANDABLE BLADE, COMPOSITE PLASTIC, BROADHEAD HUNTING ARROW TIP

BACKGROUND OF THE INVENTION

1. Field of Invention

This invention relates to arrow tips, and more particularly to hunting arrow tips, whose purpose it is to inflect a fatal wound by means of hitting, cutting and penetrating into the desired target game.

2. Prior Art

Over the last few years there has been a trend towards lighter arrows, with a lighter tip. A light weighted tip and arrow results in higher velocities and flatter trajectories during flight. These characteristics make estimating the distance of the desired target, and sighting in said target much less difficult.

Manufacturers have attempted to reduce the weight of their arrow head tips via the thickness and size of the blades, by using lighter construction materials for the tip body, i.e. aluminum, and by reducing the overall size of their tips. Although these modifications have resulted in a substantial weight reduction, at present there are no composite plastic tips on the market.

Because of the aerodynamic geometry of conventional hunting tips, they do not fly true, nor is their flight as predictable as target tips (a bullet shaped tip without fins or blades.) These trajectory variances are a result in part of the aerodynamic drag on the tip. By understanding the components that result in total drag, a design can be made to reduce these effects.

The total aerodynamic drag on an arrow is the summation of three different components i.e. induced drag, wave drag and skin-friction drag. Induced drag is associated with the kinetic energy in the tip vortices which are shed from the blades. Wave drag is a function of the tip and blade profile, and skin-friction drag are the drag forces resulting from pressure stresses acting on the surface of the blade and tip profile (skin-friction drag generally includes shear drag.)

Manufacturers of hunting arrow tips have attempted to design tips that eliminate trajectory variation, and at the same time provide a sufficient blade cut diameter to inflict a fatal wound. However these two parameters are generally conflicting. As the cut diameter increases, trajectory variation increases. In an effort to optimize said parameters, manufacturers have designed vented blades (blades that have a substantial amount of the blade material removed such that the only exposed material is along the blade perimeter) to reduce blade skin-friction drag. The thickness of the blades has also been reduced which in turn reduces the wave drag.

There has been some work to provide an expandable broadhead hunting tip wherein the blades are tucked completely into the body of the tip during flight and are caused to expand upon impact, by means of a point located on the leading end of the tip that slides transversely into the body of the tip (opposite to the flight direction.) The trailing portion of this sliding point consequently forces the blades to expand outward when the tip strikes a target. There are several inherent problems with this design. The design is characterized by a complex geometry that results in increased manufacturing expense and generates higher risk of failure because of failure of the actual tip to meet and comply with specifications in every instance of manufacture. In other words, commercial development of such a tip may easily fall below engineered design criteria because of difficulty of manufacture.

Furthermore, the non-solid point, which slides into the tip body, limits the effectiveness of the hit because the point functions like a shock absorber dissipating some of the tip's energy. In addition, the sliding mechanism in the tip can easily be contaminated with dirt and/or other contaminates causing the siding point to lockup and thus not allow the blades to open.

Finally, the blades are held within the tip body via a rubber band or o-ring. This o-ring can easily be destroyed, upon impact, by the expanding blades, thus rendering the tip useless for repeated shots. Besides these mechanical difficulties, an additional significant problem with the prior art expandable tip is that it is illegal in many States in the United States because in it's closed position, it is less than 0.875 inches in diameter which is the minimum diameter required for hunting tips. Game Wardens measure a tips' diameter when it is in the closed position because if for some reason the tip failed to open it probably would not inflict a fatal wound.

These deficiencies suggest the need for a new arrow tip design which offers both improved performance and enhanced simplicity.

OBJECTS AND SUMMARY OF THE INVENTION

It is therefore an object of the present invention to provide an arrow hunting tip which greatly improves arrow velocity and trajectory flatness.

It is a further object of this invention to provide an arrow hunting tip which enhances the repeatability and accuracy of the arrow trajectory by reducing aerodynamic drag on the tip.

It is a specific objective of this invention to provide an arrow hunting tip which is designed to give a deeper and a more devastating wound by first piercing the hide, second expanding to a large cut diameter, and third by toggling the tip deeper into the target.

Other objects and features of the present invention will be apparent to those skilled in the art when viewed with respect to the following detailed description, taken in combination with the drawings.

DETAILED DESCRIPTION OF THE INVENTION

In the following description, "forward" refers to the pointed end of the arrow tip and "base" or "stem" refers to the end of the tip that connects to the arrow.

Figure 1:
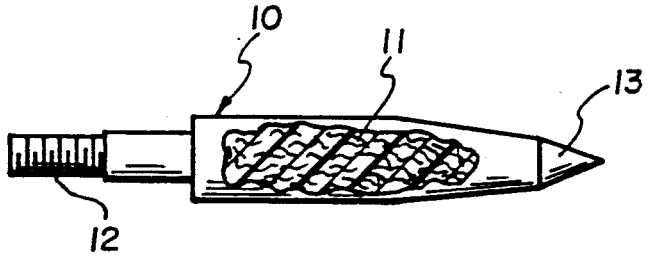
FIG. 1 shows a partial cutaway, graphic view of an arrow head utilizing fiber reinforced composite material in combination with a metallic point.

FIG. 1 shows a typical arrow head. It includes an arrowhead housing or intermediate, elongated body 10 having a central elongate axis 9, which is constructed out of a thermosetting plastic resin composite material reinforced with an imbedded fibrous medium 11. The housing member 10 has a threaded means or stem 12 which is attached at a proximal end of the intermediate body and oriented along the elongate axis 9 to enable the arrowhead tip to be securely inserted within a threaded opening in the arrow shaft. The tip has a pointed end 13 which is integrally attached at the distal end of the intermediate body and is tapered symmetrically about the elongate axis 9 to form a point oriented in a proposed direction of flight. This pointed end aids in arrowhead penetration.

The composite fibrous material provides several advantages over the materials used in current state of the art arrowheads. The utilization of a composite material, as opposed to metallic material, for the body of the arrow head tip provides a dramatic reduction in overall arrow weight. Arrow weight reduction translates directly into higher arrow velocities, and flatter trajectories which in turn makes sighting in the bow and arrow, as well as estimating the distance to the target much less sensitive.

The fibrous filler material is necessary for an arrow tip application because of the extreme conditions the tip experiences during impact. When fiber fillers are used in the composite, its properties are dramatically increased i.e. rigidity, tensile strength, impact strength, modulus of elasticity, and hardness.

When a composite material is used in place of the traditional metallic materials, the manufacturability of said arrow head tip is greatly increased. The composite tip could be injection molded to it complete and finished form without the need for machining, deburring, coating or finishing of any kind. The color of the tip can be controlled via the resin used for molding. This coloring provides superior finishing when compared to painted or anodized tips which can be scratched or chipped. The cost of manufacturing is reduced many fold, due to the lower price of composite resins compared to the cost of metallic materials. Methods used for tip fabrication can greatly reduce manufacturing costs (injection molding verses machining.) The capacity to manufacture large quantities is also greatly enhanced (e.g. one automatic injection molding machine, operating unmanned, with a 10 cavity mold, can produce approximately 45,000 tips per day.) The corrosion resistance that is gained with composite materials is far superior to the chemical resistive properties of most metallic materials.

Figure 2:
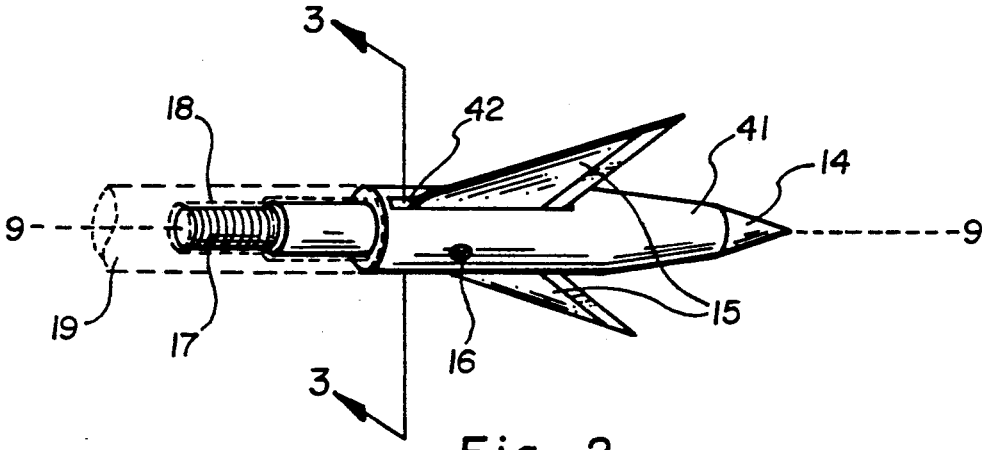
FIG. 2 shows a perspective view of a two bladed expandable broadhead hunting arrow tip with the blades in their forward pointing position.

FIG. 2 utilizes the fibrous composite tip design 41 for the intermediate body, as described in FIG. 1, with a pointed end 14, wherein the pointed end is a metal construction. The threaded mounting stem 17, is integrally formed with the intermediate body 41, as a unibody structure of fiber reinforced composite. This threaded base end can then be screwed into an arrow shaft 19 which utilizes a standard arrow tip threaded receptacle 18, thus providing the same interchangeable convenience developed with prior art tips of metal construction. Because the threaded end is injection molded, additional manufacturing cost savings are realized.

Attached or coupled to the intermediate body structure 41, are two forward pointing broadhead blades 15, each blade including a mounting end and a penetrating point. The intermediate body 41 is symmetrically shaped about a central or elongate axis 9 and includes a slot track for each blade 42 which extends directionally along the elongate axis 9, and into the intermediate body 41, to a point of attachment for the mounting end of the blade. The two slots 42, form a continuous slot passing from one side of the intermediate body 41, to the opposite side, into which the blades 15 are inserted.

The blades are trunion mounted at their respective mounting ends to a common axis pin 16. During installation of the blades, the common axis pin 16 is secured into the body. This pin passes through the intermediate body, enters the slot, through the blades and passes into the body on the other side of the slot. The trunion mounted blades are designed with a small clearance between the common axis pin 16, and the mounting hole in the blades which allows the blades to swing or pivot about the common axis pin. The slot 42 has a narrower slot opening at the forward limiting position to impose slight frictional resistance against rearward movement of the blade and retains the blades in their forward pointing position during flight. The slot has a wider opening toward the rearward direction of the slot to allow free rotational movement of the blades to the rearward projecting orientation, once the resistance against rearward movement is overcome by impact with a target object. This resistance that exists between the blades and the body is immediately alleviated after the blades are rotated a few degrees towards the rearward direction of the tip, which subsequently occurs when the blades impact a target.

Although the prior art suggests the use of trunion mounted blades, such blades are, in effect, riveted together and are not trunion mounted securely to the arrow tip body. When the blades are securely mounted in the body in accordance with the present invention, it provides firmer support of the blades which in turn results in a straighter cut and penetration path into the target. This prolongs blade life and increases tip penetration. When the blades are not trunion mounted to the body, removal of said tip from the target puts a high stress on the mechanism that holds the blades in their position in the tip body. This securing mechanism typically has a much lower strength capacity than does a configuration wherein the blades are integrally trunion mounted securely in the body.

Figure 3:
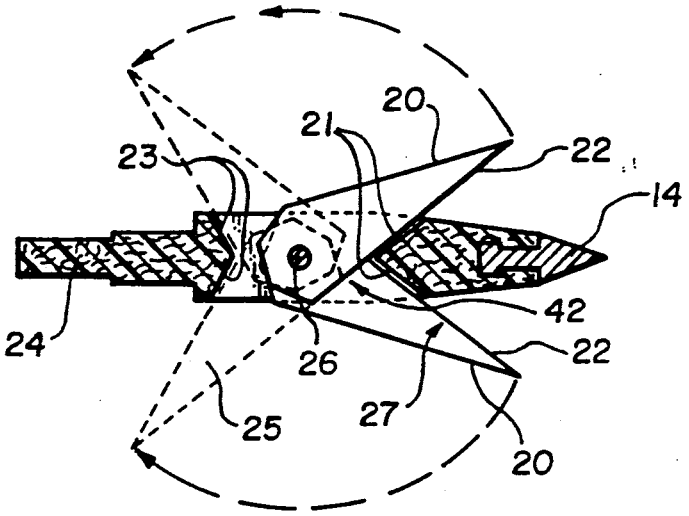
FIG. 3 is a graphic representation of the cross section of the tip shown in FIG. 2, taken along the lines 3—3.

FIG. 3 shows a cross sectional view of the arrow tip described in FIG. 2. The cross sectional view of the tip is shown wherein the pointed end 14 is comprised of a metal composition and is configured with a pointed body and a mounting stem which extends within the composite structure of the intermediate body and provides a mechanical interlock means to retain the pointed end securely attached to the intermediate body.

The cross sectional view of the slot 42 of FIG. 2 is shown by the center section area of tip body 24 that is not cross hatched. The slot includes a leading edge configured to block forward rotational movement of the blade beyond a forward limiting position and a trailing edge for blocking rearward rotational movement beyond a rearward limiting position.

Each broadhead blade is pivotally attached at its mounting end to the intermediate body 41 such that the blades may be moved or rotated from a forward projecting orientation wherein the penetrating end is directed toward the direction of flight to a rearward position wherein the penetrating end is oriented away from the direction of flight, the penetrating tip being biased during flight to an exposed condition outside the intermediate body. As the current inventive tip impacts and penetrates the target, the blades 27 rotate on the common pivot pin 26 towards the rearward end of the arrow head tip, the penetrating point of the blades sweeps along the phantom lines 43 and terminates in position 25. The back edge of the blades 20 position themselves against the back of the slot in the tip body 23 thus limiting their rearward rotation in the body. This stoppage ensures a correct blade cut diameter. When the blades 27 are rotated to their forward pointing position, the forward or cutting edge 22 of the blades comes in contact with the forward end of the slot 21. This prohibits the blades from folding completely forward into the tip body 24, and thus ensures a minimum cut diameter for the tip, which is designed to meet most States Fish and Game requirements. This is in direct contrast with prior art, expandable broadhead tips that are completely folded into the body of the tip.

The design configuration of the forward pointing blades in the composite body has several distinct advantages over conventional arrow tips. First the aerodynamic induced drag on the blades of the tip has been essentially eliminated. This is due primarily to the forward pointing blades which greatly reduce the kinetic energy in the tip vortices. Second, the wave drag on the blades has been reduced approximately 70% via the smaller blade profile. This arises because less than one third of the blades are in an exposed position when the tip is in flight. Third, the skin-friction and shear drag, on the blades has also been reduced approximately 60% because of the small initial blade surface area exposure. The overall effect of these three drag reduction characteristics has resulted in a hunting tip that has essentially the same trajectory as a target tip. It will be apparent to those skilled in the art that development of a broadhead having the same trajectory as a target tip represents a significant step forward in the field of archery. The combined advantages of durability for the composite body and enhanced trajectory similar to a target arrow present a much improved hunting arrow over conventional arrows.

Figure 4:
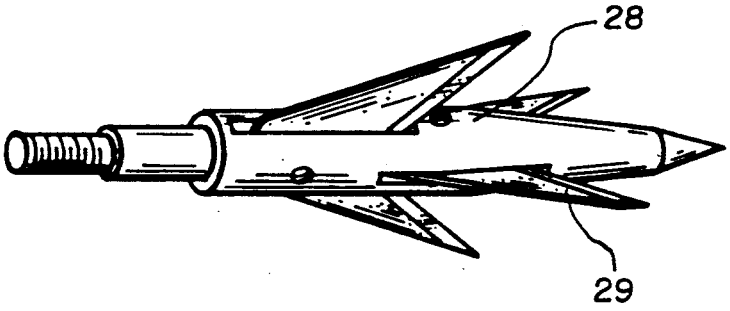
FIG. 4 illustrates a perspective view of an alternate embodiment showing the present invention utilizing four blades, the two additional blades being shown in an opposing plane.

FIG. 4 is a graphic representation of an other embodiment of the present invention. This is a four bladed, expandable broadhead arrow hunting tip configuration. It has all the advantages of the two bladed version, as previously discussed, however it has an additional two blades 29, which are similarly trunion mounted in the body via a second common axis pin 28. The two pair of blades are oriented along two separate planes which are offset by approximately 90 degrees of rotation along the elongate axis. The two additional blades are designed to function in a similar fashion to the two bladed configuration wherein the respective two pair of blades are rotatably positioned within two pair of slot tracks having forward and rearward limiting positions which bias the respective blades in forward position during flight, with rotation to a rearward position upon impact with a target object.

Figure 5:
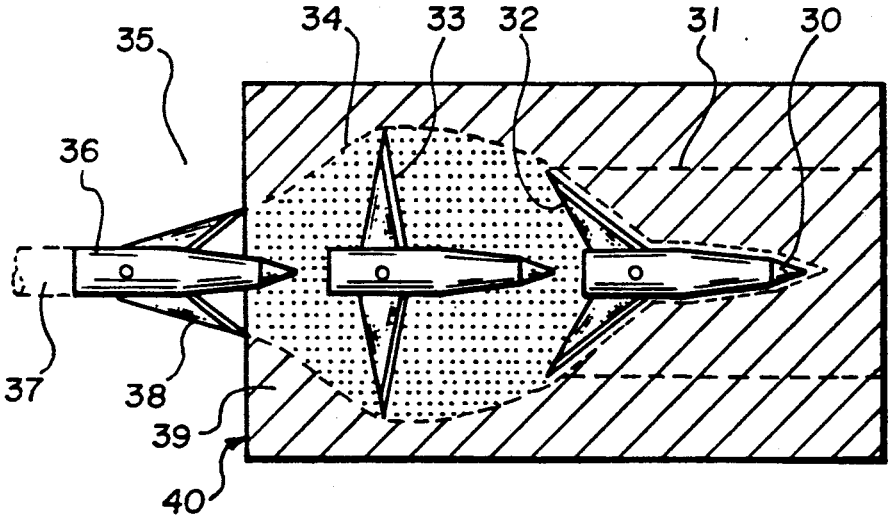
FIG. 5 graphically illustrates the target penetration functionality of the two bladed expandable broadhead tip.

FIG. 5 illustrates the process associated with (i) the flight prior to impact, (ii) the impact, (iii) the piercing, (iv) the cutting and (v) the subsequent penetration of the expandable broadhead hunting arrow tip. When in flight through the air 35, the broadhead tip 36 and arrow shaft 37 are shown with the blades only partially exposed, the penetrating points of the blades being biased during flight to an exposed condition outside the intermediate body, thus providing all of the advantages previously outlined. When the tip 36 impacts the hide or outer surface of the target 40 (which is normally tougher than the areas 39 immediately beneath the surface of this outer layer), the forward pointed blades utilize the sharp, dart like points of the blades to pierce rather than cut this tougher outer layer. After the outer surface 40 has been pierced, the drag on the blades 38 increases dramatically as they pass through the softer tissue 39. This increased drag causes the blades to rotate to the rearward projecting orientation 33. The profile of the cut is represented in FIG. 5 by the dashed line 34 and the area depicted by the coarsely dotted section. As the arrow and tip continue to penetrate into the tissue 39, the blades rotate to the final rearward position 32. In this final position the blades are blocked from any further rotation, consequently their cut diameter path remains constant. This final cut path is projected through the tissue as shown by the dashed line 34.

In addition to the advantages previously outlined, this invention has been shown to penetrate much deeper than a conventional tip thus rendering a more devastating wound. This occurs because the tip pierces, rather than cuts, the outer surface. After entering the target, the point 30 is toggled deeper into the target, this motion is a result of the blades rotating in the tip body. This rotational motion of the blades in the body creates a relative forward surge motion wherein the arrowhead tip 30, moves a greater distance than do the blades.

It is to be understood that the foregoing description is by way of example and is not to be construed as limiting with respect to the following claims.

I claim:

1. An arrowhead tip for attachment to an arrow shaft, said tip comprising:

an intermediate, elongated body having a central, elongate axis and being formed as a fiber reinforced composite of thermosetting resin and imbedded fibers;

a pointed end integrally attached at a distal end of the intermediate body and tapered symmetrically about the elongate axis to form a point oriented in a proposed direction of flight;

a threaded stem attached at a proximal end of the intermediate body and oriented along the elongate axis to enable the arrowhead tip to be securely inserted within a threaded opening in the arrow shaft; and broadhead blades coupled to the intermediate body to form a broadhead arrow tip, each blade including a mounting end and a penetrating point;

wherein each broadhead blade is pivotally attached at the mounting end to the intermediate body such that the blades may be moved from a forward projecting orientation wherein the penetrating point is directed toward the direction of flight to a rearward position wherein the penetrating point is oriented away from the direction of flight, the penetrating point being biased during flight to an exposed condition outside the intermediate body; and wherein the intermediate body includes a slot track for each broadhead blade, said slot track extending directionally along the elongate axis and into the intermediate body to a point of attachment for the mounting end of the broadhead blade and including a leading edge configured to block forward movement of the blade beyond a forward limiting position and a trailing edge for blocking rearward movement beyond a rearward limiting, position, the slot track having a narrower slot opening at the forward limiting position slightly larger than broadhead blade width to impose slight frictional resistance against rearward movement of the broadhead blade during flight, said slot track having a progressive increase in opening size toward a rearward direction to allow free movement of the broadhead blade to the rearward projecting orientation once the resistance against rearward movement is overcome by impact with a target object.

2. An arrowhead tip as defined in claim 1 wherein the threaded stem is integrally formed with the intermediate body as a unibody structure of fiber reinforced composite.

3. An arrowhead tip as defined in claim 1 wherein the intermediate body includes:

two opposing slot tracks formed within a single plane passing through the elongate axis, and two broadhead blades respectively mounted within the respective two slot tracks and at a single axis point within the intermediate body by mounting means positioned transverse to the single plane.

4. An arrowhead tip as defined in claim 3 wherein the two slot tracks form a continuous slot passing from one side of the intermediate body to an opposite side, the two blades being trunion mounted at their respective mounting ends to a common axis pin.

5. An arrowhead tip as defined in claim 1 wherein the arrowhead tip includes three broadhead blades mounted to the intermediate body.

6. An arrowhead tip as defined in claim 1 wherein the arrowhead tip includes two pair of broadhead blades, with the two pair of blades being oriented along two separate planes which are offset by approximately 90 degrees of rotation along the elongate axis.

* * * * *